US011109175B2

(12) United States Patent
Tu et al.

(10) Patent No.: US 11,109,175 B2
(45) Date of Patent: Aug. 31, 2021

(54) SOUND OUTPUTTING DEVICE, PROCESSING DEVICE AND SOUND CONTROLLING METHOD THEREOF

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 16/506,371

(22) Filed: Jul. 9, 2019

(65) Prior Publication Data

US 2020/0021938 A1 Jan. 16, 2020

(30) Foreign Application Priority Data

Jul. 16, 2018 (TW) ..... 107124545

(51) Int. Cl.
*H04S 7/00* (2006.01)
*H04S 1/00* (2006.01)

(52) U.S. Cl.
CPC ..... *H04S 7/303* (2013.01); *H04S 1/007* (2013.01); *H04S 2420/01* (2013.01)

(58) Field of Classification Search
CPC ..... H04S 7/303; H04S 7/301; H04S 7/302; H04S 7/304; H04S 1/007; H04S 1/002; H04S 1/005; H04S 2420/01; H04S 2400/01; H04R 5/02; H04R 5/033; H04R 5/04; H04R 3/12
USPC ..... 381/303, 309, 310
See application file for complete search history.

(56) References Cited

U.S. PATENT DOCUMENTS

| | | | | |
|---|---|---|---|---|
| 8,681,997 | B2 | 3/2014 | Karaoguz | |
| 9,843,883 | B1 | 12/2017 | Su | |
| 2005/0135643 | A1* | 6/2005 | Lee | H04S 7/301 381/309 |
| 2011/0299707 | A1 | 12/2011 | Meyer | |
| 2016/0134987 | A1 | 5/2016 | Gorzel et al. | |
| 2016/0284059 | A1 | 9/2016 | Gonzalez | |

(Continued)

FOREIGN PATENT DOCUMENTS

| | | | |
|---|---|---|---|
| CN | 102651831 | A | 8/2012 |
| CN | 105120421 | A | 12/2015 |

(Continued)

OTHER PUBLICATIONS

Chinese Office Action and Search Report for Chinese Application No. 201810800970.8, dated Dec. 2, 2020.

*Primary Examiner* — Ahmad F. Matar
*Assistant Examiner* — Sabrina Diaz
(74) *Attorney, Agent, or Firm* — Birch, Stewart, Kolasch & Birch, LLP

(57) ABSTRACT

A sound outputting device, a processing device and a sound controlling method thereof are provided. The sound controlling method includes the following steps. An original left sound signal and an original right sound signal are received. The original left sound signal and the original right sound signal are transformed to be a virtual left sound signal and a virtual right sound signal of a virtual sound source. A rotation degree of a user is detected. The virtual left sound signal and the virtual right sound signal are transformed to be an updated left sound signal and an updated right sound signal.

11 Claims, 5 Drawing Sheets

(56) References Cited

U.S. PATENT DOCUMENTS

| | | | | |
|---|---|---|---|---|
| 2017/0353812 | A1* | 12/2017 | Schaefer | H04R 3/04 |
| 2018/0091917 | A1 | 3/2018 | Chon et al. | |

FOREIGN PATENT DOCUMENTS

| | | | |
|---|---|---|---|
| CN | 105376690 | A | 3/2016 |
| CN | 106537941 | A | 3/2017 |
| TW | 201740744 | A | 11/2017 |
| WO | WO 2017/119320 | A1 | 7/2017 |

* cited by examiner

SOUND OUTPUTTING DEVICE, PROCESSING DEVICE AND SOUND CONTROLLING METHOD THEREOF

This application claims the benefit of Taiwan application Serial No. 107124545, filed Jul. 16, 2018, the subject matter of which is incorporated herein by reference.

BACKGROUND OF THE INVENTION

Field of the Invention

The invention relates to a sound outputting device, a processing device and a sound controlling method thereof, and more particular to a two-channel sound outputting device, a processing device and a sound controlling method thereof.

Description of the Related Art

Along with the development of the interactive display technology, various interactive display devices have been continuously introduced. For example, the user may wear a head-mounted display (HMD) to display a picture of virtual reality (VR) in front of their eyes. As the user moves or rotates, the head-mounted display can present a corresponding picture, allowing the user to feel like being in a certain virtual scene.

However, in the current application, although the picture can change as the user rotates, the sound signal still remains the same. This causes a great reduction of the user's presence.

SUMMARY OF THE INVENTION

The invention relates to a sound outputting device, a processing device and a sound controlling method thereof. The sound signal is transformed according to the rotation of the user to improve the user's presence.

According to the first aspect of this invention, a sound controlling method is proposed. The sound controlling method includes the following steps. An original left sound signal and an original right sound signal are received. The original left sound signal and the original right sound signal are transformed to be a virtual left sound signal and a virtual right sound signal of a virtual sound source. A rotation degree of a user is detected. The virtual left sound signal and the virtual right sound signal are transformed to be an updated left sound signal and an updated right sound signal.

According to the second aspect of this invention, a sound outputting device is proposed. The sound outputting device includes a receiving unit, a first transforming unit, a detecting unit, a second transforming unit, a left sound outputting unit, and a right sound outputting unit. The receiving unit is used to receive an original left sound signal and an original right sound signal. The first transforming unit is used to transform the original left sound signal and the original right sound signal into a virtual left sound signal and a virtual right sound signal of a virtual sound source. The detecting unit is used to detect a rotation degree of the user. The second transforming unit is used to transform the virtual left sound signal and the virtual right sound signal into an updated left sound signal and an updated right sound signal according to the rotation degree. The left sound outputting unit is used to output the updated left sound signal. The right sound outputting unit is used to output the updated right sound signal.

According to the third aspect of this invention, a processing device is proposed. The processing device is connected to a sound outputting device. The processing device includes a receiving unit, a first transforming unit, a detecting unit, and a second transforming unit. The receiving unit is used to receive an original left sound signal and an original right sound signal. The first transforming unit is used to transform the original left sound signal and the original right sound signal into a virtual left sound signal and a virtual right sound signal of a virtual sound source. The detecting unit is used to detect a rotation degree of the user. The second transforming unit is used to transform the virtual left sound signal and the virtual right sound signal into an updated left sound signal and an updated right sound signal according to the rotation degree. The updated left sound signal and the updated right sound signal are transmitted to the sound outputting device.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
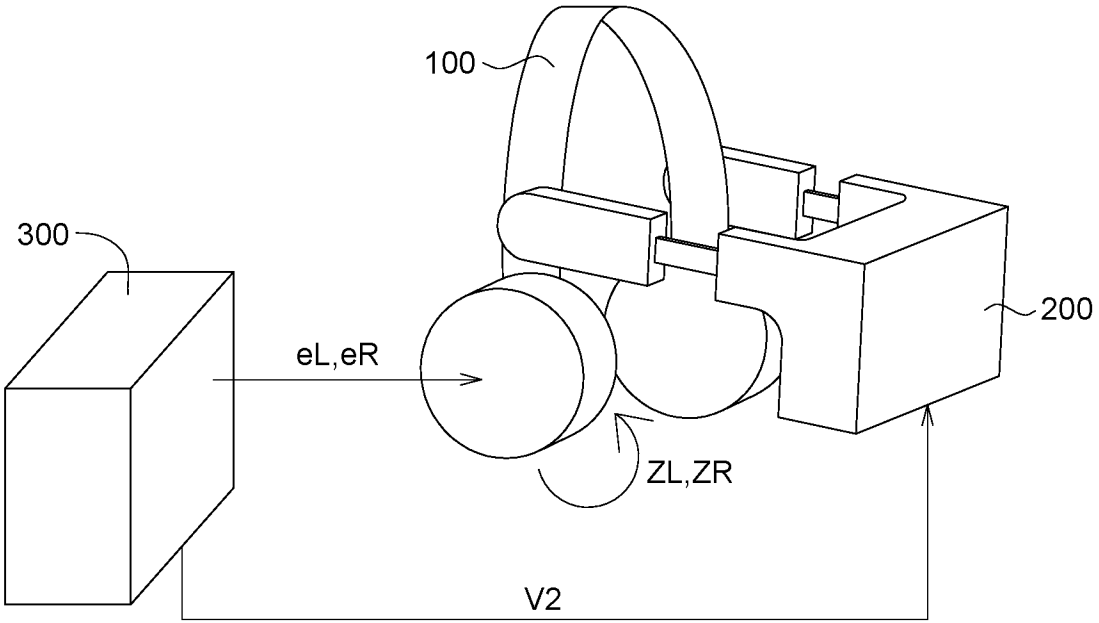
FIG. 1 shows a schematic diagram of a sound outputting device, a head-mounted display, and a processing device according to an embodiment.

Referring to FIG. 1, it shows a schematic diagram of a sound outputting device 100, a head-mounted display 200, and a processing device 300 according to an embodiment. The sound outputting device 100 can be used with the head-mounted display 200 to allow the user to play a virtual reality (VR) game, or to visit a virtual store. The displaying content V2 of the head-mounted display 200 and an original left sound signal eL and an original right sound signal eR of the sound outputting device 100 are provided by the processing device 300. As the user rotates, the displaying content V2 will change accordingly. In this embodiment, according to the rotation of the user, the original left sound signal eL and the original right sound signal eR can be transformed into an updated left sound signal ZL and an updated right sound signal ZR to improve the user's presence.

Figure 2:
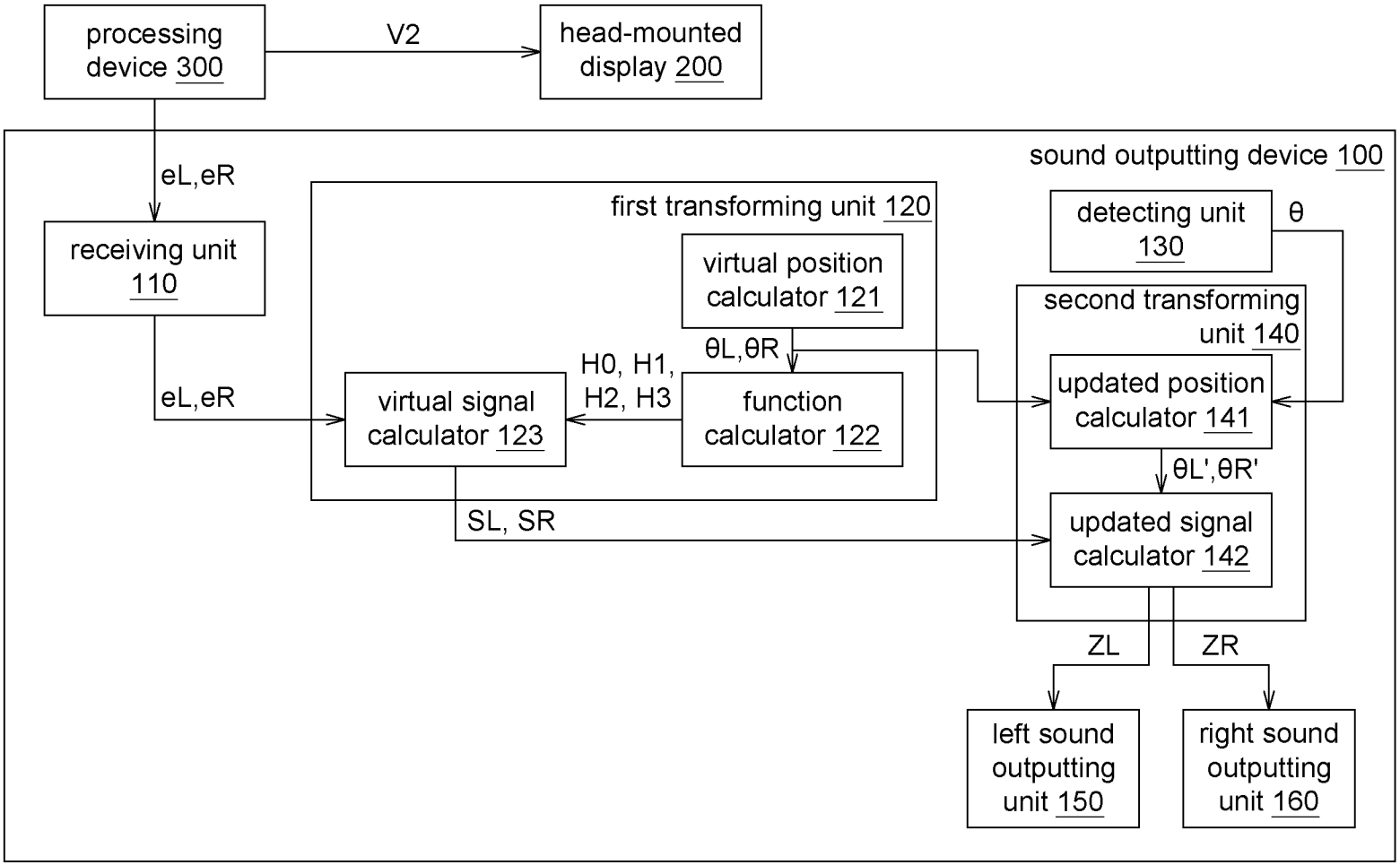
FIG. 2 shows a block diagram of a sound outputting device.

Referring to FIG. 2, it shows a block diagram of a sound outputting device 100. The sound outputting device 100 comprises a receiving unit 110, a first transforming unit 120, a detecting unit 130, a second transforming unit 140, a left sound outputting unit 150, and a right sound outputting unit 160. The receiving unit 110, e.g., a wireless communication module, or a wired network module, is used for receiving signal. Each of the first transforming unit 120 and the second transforming unit 140, for example, is a circuit, a chip, a circuit board, or a storage device that stores several groups of codes. The detecting unit 130, e.g., a gyro, an accelerometer, an infrared (IR) detector, is used to detect the user's rotation. The left sound outputting unit 150 and the right sound outputting unit 160, for example, is an earphone. The operation of those elements is described in more detail as follows, according to the flow chart.

Figure 3:
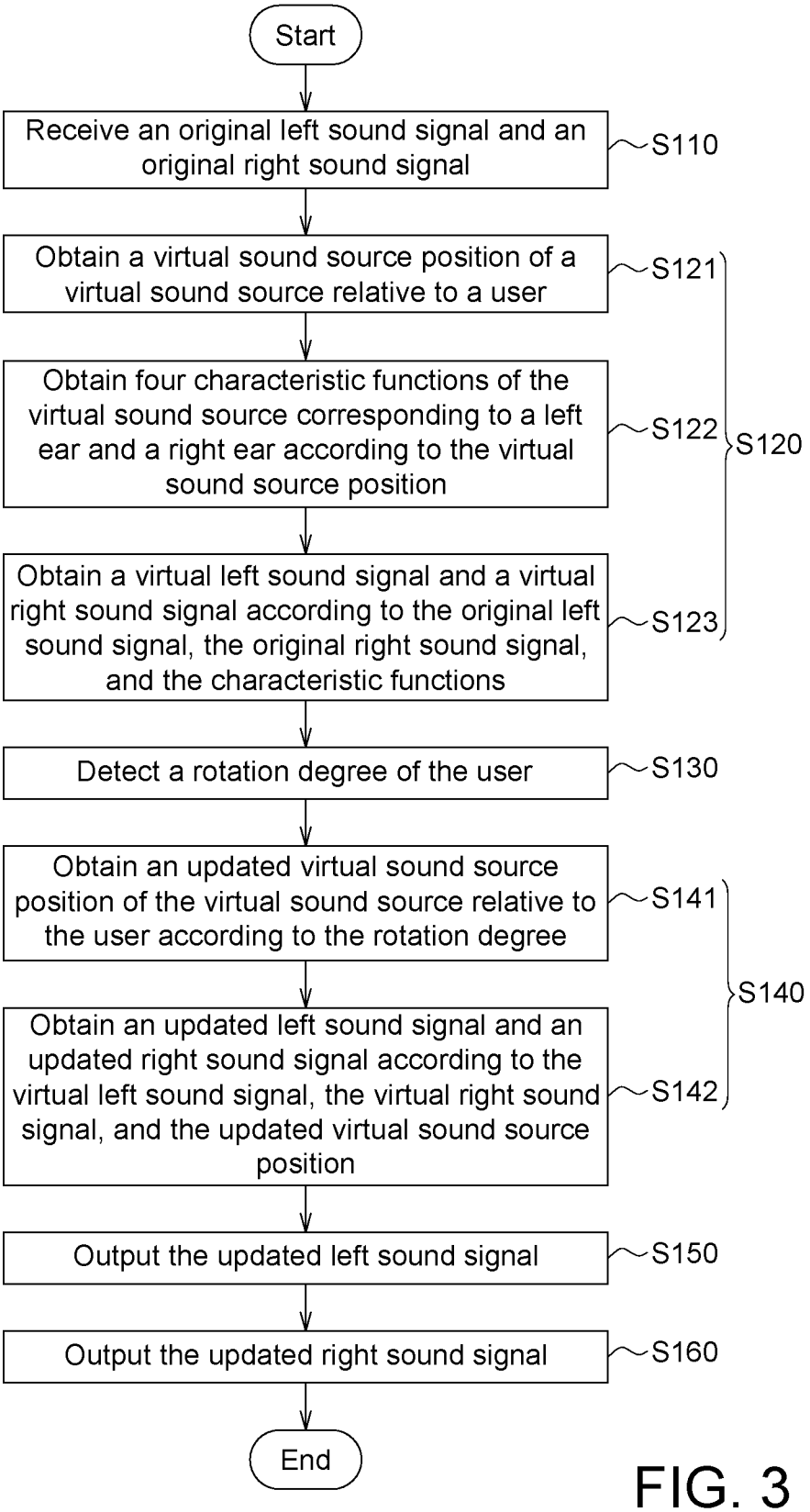
FIG. 3 shows a flow chart of a sound controlling method according to an embodiment.

Referring to FIG. 3, it shows a flow chart of a sound controlling method according to an embodiment. In step S110, the receiving unit 110 receives an original left sound signal eL and an original right sound signal eR. In convention, the original left sound signal eL and the original right sound signal eR are transmitted directly to the left sound outputting unit 150 and the right sound outputting unit 160 for outputting, respectively. But in this embodiment, by transforming the original left sound signal eL and the original right sound signal eR into the updated left sound signal ZL and the updated right sound signal ZR through the first transforming unit 120 and the second transforming unit 140, the user's presence can be improved.

Figure 4:
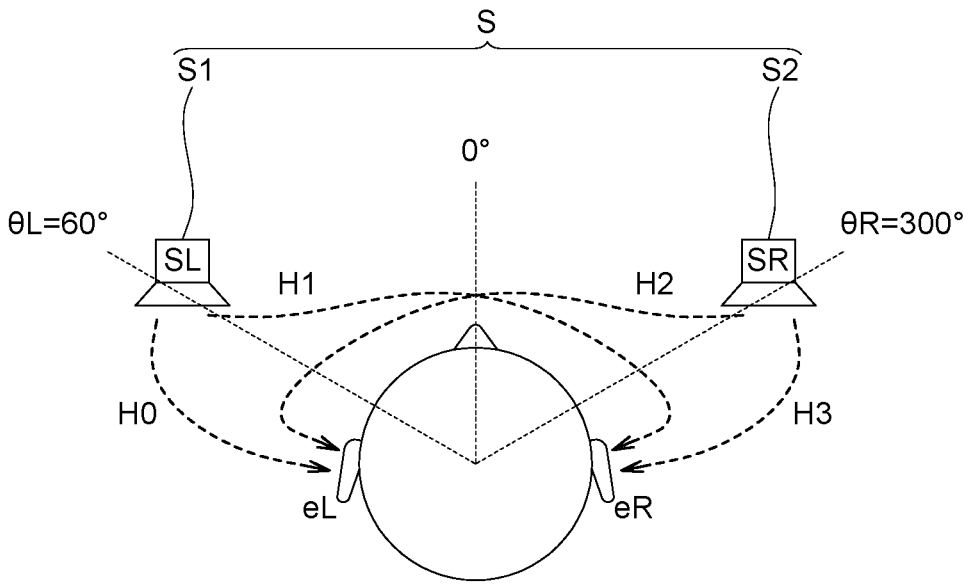
FIG. 4 shows a schematic diagram of a virtual sound source.

In step S120, the first transforming unit 120 transforms the original left sound signal eL and the original right sound signal eR into a virtual left sound signal SL and a virtual right sound signal SR of a virtual sound source S. Referring to FIG. 4, it shows a schematic diagram of the virtual sound source S. If the virtual left sound signal SL and the virtual right sound signal SR sent out from the virtual sound source S are known, the original left sound signal eL and the original right sound signal eR can be calculated through the calculation of the Head Related Transfer Functions (HRTF) technology. In the step S120, in the case that the virtual sound source S is unknown, the virtual left sound signal SL and the virtual right sound signal SR are calculated according to the original left sound signal eL and the original right sound signal eR.

In more details, step S120 comprises steps S121 to S123. In step S121, a virtual position calculator 121 of the first transforming unit 120 obtains a virtual sound source position of a virtual sound source S relative to the user. The virtual sound source S comprises a first virtual speaker S1 and a second virtual speaker S2. The virtual sound source position comprises a first relative degree θL of the first virtual speaker S1 relative to the user, and a second relative degree θR of the second virtual speaker S2 relative to the user.

In step S122, a function calculator 122 of the first transforming unit 120 obtains the characteristic functions H0, H1, H2, H3 of the virtual sound source S corresponding to a left ear and a right ear according to the virtual sound source position (i.e., the first relative degree θL and the second relative degree θR).

In step S123, a virtual signal calculator 123 of the first transforming unit 120 obtains a virtual left sound signal SL and a virtual right sound signal SR according to the original left sound signal eL, the original right sound signal eR, and the characteristic functions H0, H1, H2, H3. For instance, the virtual signal calculator 123, for example, calculates the virtual left sound signal SL and the virtual right sound signal SR according to the following equation (1).

$$\begin{bmatrix} SL \\ SR \end{bmatrix} = \frac{1}{H0 \cdot H3 - H1 \cdot H2} \begin{bmatrix} H3 & -H1 \\ -H2 & H0 \end{bmatrix} \begin{bmatrix} eL \\ eR \end{bmatrix} \quad (1)$$

Figure 5:
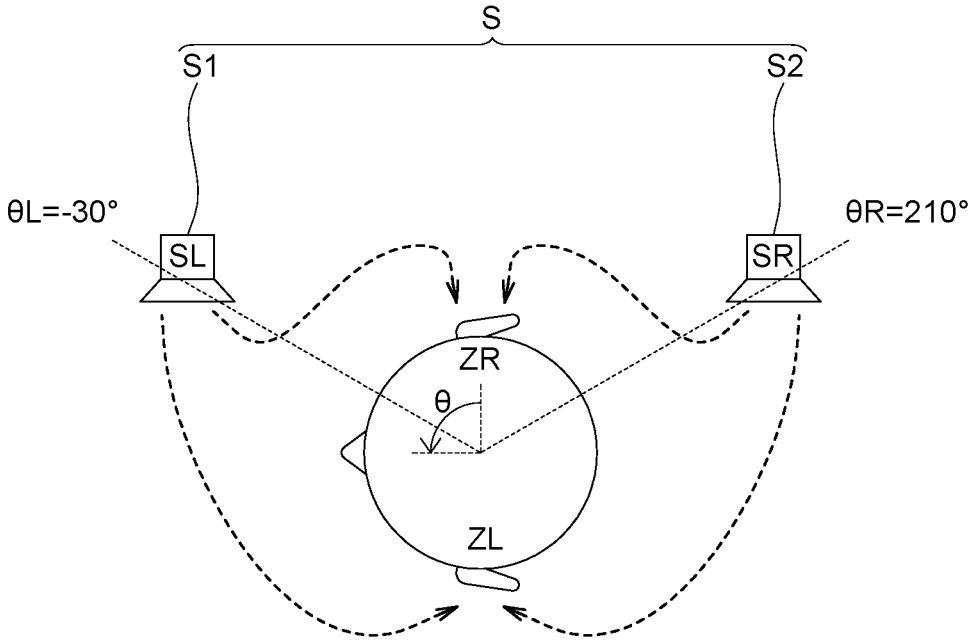
FIG. 5 shows a situation of a user's rotation.

Next, in step S130, the detecting unit 130 detects a rotation degree A of the user. In this embodiment, the rotation degree θ detected by the detecting unit 130 comprises a direction value, for example, rotating in a counterclockwise direction is a positive direction. Referring to FIG. 5, it illustrates a situation of a user's rotation. In FIG. 5, the user rotates 90 degree, so the detecting unit 130 may detect that the rotation degree θ is +90 degree.

Then, in step S140, the second transforming unit 140 transforms the virtual left sound signal SL and the virtual right sound signal SR into the updated left sound signal ZL and the updated right sound signal ZR according to the rotation degree A. In this embodiment, in the case that the virtual sound source S is unknown, the updated left sound signal ZL and the updated right sound signal ZR are calculated according to the virtual left sound signal SL and the virtual right sound signal SR which are calculated according to the user's rotation.

In more details, step S140 comprises steps S141 to S142. In step S141, an updated position calculator 141 of the second transforming unit 140 obtains an updated virtual sound source position of the virtual sound source S relative to the user according to the rotation degree θ. The updated virtual sound source position includes a first updated relative degree θL' relative to the user and a second updated relative degree θR' relative to the user. The updated position calculator 141, for example, obtains the first updated relative degree θL' and the second updated relative degree θR' according to the following equations (2) and (3).

$$\theta L' = \theta L - \theta \quad (2)$$

$$\theta R' = \theta R - \theta \quad (3)$$

In step S142, the updated signal calculator 142 of the second transforming unit 140 obtains an updated left sound signal ZL and an updated right sound signal ZR according to the virtual left sound signal SL, the virtual right sound signal SR, and the updated virtual sound source position (i.e., the first updated relative degree θL' and the second updated relative degree θR').

Then, in step S150, the left sound outputting unit 150 outputs the updated left sound signal ZL. In step S160, the right sound outputting unit 160 outputs the updated right sound signal ZR.

As a result, the original left sound signal eL and the original right sound signal can be transformed into the updated left sound signal ZL and the updated right sound signal ZR according to the user's rotation to improve the user's presence.

To be noted, this embodiment is not only related to how to perform a signal transformation, but also allows the general sound signal to be intercepted and transformed into a sound signal corresponding to the user's rotation through the implementation of the steps and elements stated above.

Especially, one of the problems to be solved in this embodiment is how to transform a sound signal corresponding to the user's rotation in the case that the virtual sound source is unknown. According to the description above, this embodiment proposes a specific inverse calculation technology to obtain the virtual sound source, and is further capable of transforming the sound signal corresponding to the user.

Figure 6:
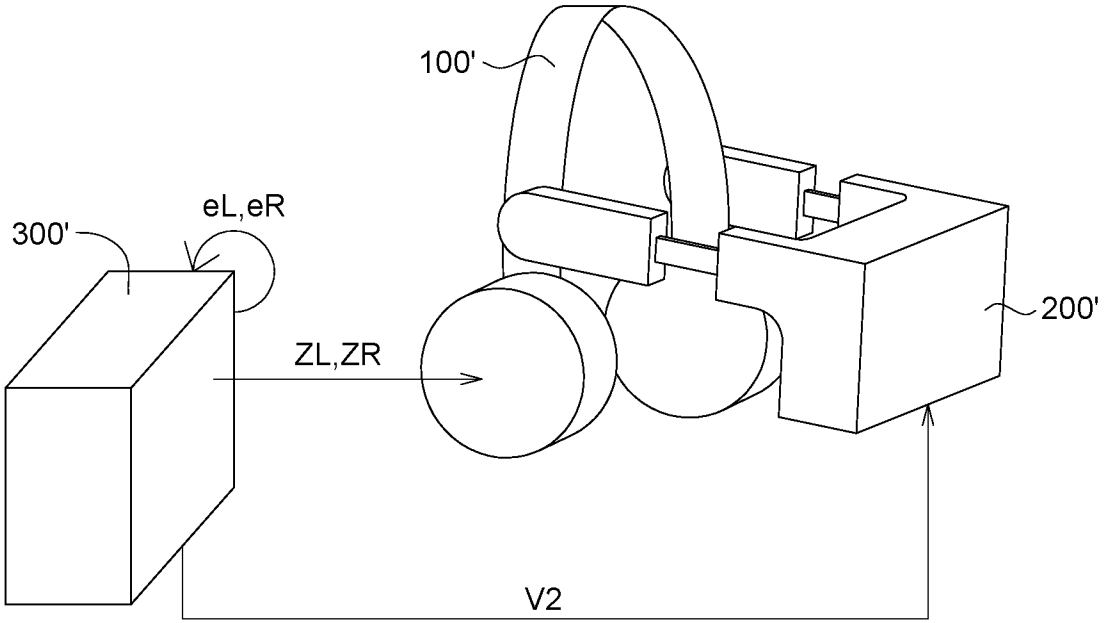
FIG. 6 shows a schematic diagram of a sound outputting device, a head-mounted display, and a processing device according to another embodiment.

Referring to FIG. 6, it shows a schematic diagram of a sound outputting device 100', a head-mounted display 200', and a processing device 300' according to another embodiment. In this embodiment, the receiving unit 110, the first transforming unit 120, and the second transforming unit 140 stated above may be arranged in the processing device 300'. The original left sound signal eL and the original right sound signal eR are transformed into the updated left sound signal ZL and the updated right sound signal ZR through the calculation of the processing device 300', after that, the updated left sound signal ZL and the updated right sound signal ZR are outputted to the sound outputting device 100'.

In this embodiment, when the detecting unit 130 stated above is arranged at the sound outputting device 100', the rotation degree θ can be transmitted to the processing device 300' by the sound outputting device 100' to perform calculation. Or, in another embodiment, when the detecting unit 130 stated above is arranged at the processing device 300' (e.g., using an infrared sensor), the rotation degree θ does not have to be transmitted to the sound outputting device 100', and the calculation may be performed at the processing device 300' directly.

While the invention has been described by example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A sound controlling method, comprising:

receiving an original left sound signal and an original right sound signal;

transforming, through a calculation of Head Related Transfer Functions (HRTF), the original left sound signal and the original right sound signal into a virtual left sound signal and a virtual right sound signal of a virtual sound source which is unknown, wherein the virtual right sound signal is different from the original right sound signal, and the virtual left sound signal is different from the original left sound signal;

detecting a rotation degree of a user; and transforming the virtual left sound signal and the virtual right sound signal into an updated left sound signal and an updated right sound signal according to the rotation degree, wherein the step of transforming the original left sound signal and the original right sound signal into the virtual left sound signal and the virtual right sound signal of the virtual sound source comprises:

obtaining a virtual sound source position of the virtual sound source relative to the user;

obtaining four characteristic functions of the virtual sound source corresponding to a left ear and a right ear according to the virtual sound source position; and obtaining the virtual left sound signal and the virtual right sound signal according to the original left sound signal, the original right sound signal, and the four characteristic functions; and the virtual left sound signal and the virtual right sound signal are calculated according to the following equation:

$$\begin{bmatrix} SL \\ SR \end{bmatrix} = \frac{1}{H0 \cdot H3 - H1 \cdot H2} \begin{bmatrix} H3 & -H1 \\ -H2 & H0 \end{bmatrix} \begin{bmatrix} eL \\ eR \end{bmatrix},$$

wherein SL represents the virtual left sound signal, SR represents the virtual right sound signal; eL represents the original left sound signal, eR represents the original right sound signal; H0 represents a first characteristic function, H1 represents a second characteristic function, H2 represents a third characteristic function and H3 represents a fourth characteristic function.

2. The sound controlling method of claim 1, wherein the step of transforming the virtual left sound signal and the virtual right sound signal into the updated left sound signal and the updated right sound signal according to the rotation degree comprises:

obtaining an updated virtual sound source position of the virtual sound source relative to the user according to the rotation degree; and obtaining the updated left sound signal and the updated right sound signal according to the virtual left sound signal, the virtual right sound signal, and the updated virtual sound source position.

3. The sound controlling method of claim 2, wherein the virtual sound source comprises a first virtual speaker and a second virtual speaker;

the virtual sound source position comprises a first relative degree of the first virtual speaker relative to the user, and a second relative degree of the second virtual speaker relative to the user; and the updated virtual sound source position comprises a first updated relative degree of the first virtual speaker relative to the user, and a second updated relative degree of the second virtual speaker relative to the user.

4. A sound outputting device, comprising:

a receiving unit used to receive an original left sound signal and an original right sound signal;

a first transforming unit used to transform, through a calculation of Head Related Transfer Functions (HRTF), the original left sound signal and the original right sound signal into a virtual left sound signal and a virtual right sound signal of a virtual sound source which is unknown, wherein the virtual right sound signal is different from the original right sound signal, and the virtual left sound signal is different from the original left sound signal;

a detecting unit used to detect a rotation degree of a user;

a second transforming unit used to transform the virtual left sound signal and the virtual right sound signal into an updated left sound signal and an updated right sound signal according to the rotation degree;

a left sound outputting unit used to output the updated left sound signal; and a right sound outputting unit used to output the updated right sound signal, wherein the first transforming unit comprises:

a virtual position calculator used to obtain a virtual sound source position of the virtual sound source relative to the user;

a function calculator used to obtain four characteristic functions of the virtual sound source corresponding to a left ear and a right ear according to the virtual sound source position; and a virtual signal calculator used for obtaining the virtual left sound signal and the virtual right sound signal according to the original left sound signal, the original right sound signal, and the four characteristic functions; and the virtual left sound signal and the virtual right sound signal are calculated according to the following equation:

$$\begin{bmatrix} SL \\ SR \end{bmatrix} = \frac{1}{H0 \cdot H3 - H1 \cdot H2} \begin{bmatrix} H3 & -H1 \\ -H2 & H0 \end{bmatrix} \begin{bmatrix} eL \\ eR \end{bmatrix},$$

wherein SL represents the virtual left sound signal, SR represents the virtual right sound signal; eL represents the original left sound signal, eR represents the original right sound signal; H0 represents a first characteristic function, H1 represents a second characteristic function, H2 represents a third characteristic function and H3 represents a fourth characteristic function.

5. The sound outputting device of claim 4, wherein the second transforming unit comprises:

an updated position calculator used to obtain an updated virtual sound source position of the virtual sound source relative to the user according to the rotation degree; and an updated signal calculator used to obtain the updated left sound signal and the updated right sound signal according to the virtual left sound signal, the virtual right sound signal, and the updated virtual sound source position.

6. The sound outputting device of claim 5, wherein the virtual sound source comprises a first virtual speaker and a second virtual speaker;

the virtual sound source position comprises a first relative degree of the first virtual speaker relative to the user, and a second relative degree of the second virtual speaker relative to the user; and the updated virtual sound source position comprises a first updated relative degree of the first virtual speaker relative to the user, and a second updated relative degree of the second virtual speaker relative to the user.

7. The sound outputting device of claim 4, wherein the rotation degree is transmitted to a processing device by the sound outputting device to perform a calculation.

8. A processing device connected to a sound outputting device, wherein the processing device comprises:

a receiving unit used to receive an original left sound signal and an original right sound signal;

a first transforming unit used to transform, through a calculation of Head Related Transfer Functions (HRTF), the original left sound signal and the original right sound signal into a virtual left sound signal and a virtual right sound signal of a virtual sound source which is unknown, wherein the virtual right sound signal is different from the original right sound signal, and the virtual left sound signal is different from the original left sound signal;

a detecting unit used to detect a rotation degree of a user; and a second transforming unit used to transform the virtual left sound signal and the virtual right sound signal into an updated left sound signal and an updated right sound signal according to the rotation degree, the updated left sound signal and the updated right sound signal are transmitted to the sound outputting device, wherein the first transforming unit comprises:

a virtual position calculator used to obtain a virtual sound source position of the virtual sound source relative to the user;

a function calculator used to obtain four characteristic functions of the virtual sound source corresponding to a left ear and a right ear according to the virtual sound source position; and a virtual signal calculator used to obtain the virtual left sound signal and the virtual right sound signal according to the original left sound signal, the original right sound signal, and the four characteristic functions; and the virtual left sound signal and the virtual right sound signal are calculated according to the following equation:

$$\begin{bmatrix} SL \\ SR \end{bmatrix} = \frac{1}{H0 \cdot H3 - H1 \cdot H2} \begin{bmatrix} H3 & -H1 \\ -H2 & H0 \end{bmatrix} \begin{bmatrix} eL \\ eR \end{bmatrix},$$

wherein SL represents the virtual left sound signal, SR represents the virtual right sound signal; the eL represents the original left sound signal, eR represents the original right sound signal; H0 represents a first characteristic function, H1 represents a second characteristic function, H2 represents a third characteristic function and H3 represents a fourth characteristic function.

9. The processing device of claim 8, wherein the second transforming unit comprises:

an updated position calculator used to obtain an updated virtual sound source position of the virtual sound source relative to the user according to the rotation degree; and an updated signal calculator used to obtain the updated left sound signal and the updated right sound signal according to the virtual left sound signal, the virtual right sound signal, and the updated virtual sound source position.

10. The processing device of claim 9, wherein the virtual sound source comprises a first virtual speaker and a second virtual speaker;

the virtual sound source position comprises a first relative degree of the first virtual speaker relative to the user, and a second relative degree of the second virtual speaker relative to the user; and the updated virtual sound source position comprises a first updated relative degree of the first virtual speaker relative to the user, and a second updated relative degree of the second virtual speaker relative to the user.

11. The processing device of claim 8, wherein the rotation degree does not have to be transmitted to the sound outputting device, and a calculation is performed at the processing device directly.

* * * * *